US006854504B2

(12) United States Patent
Nien

(10) Patent No.: US 6,854,504 B2
(45) Date of Patent: Feb. 15, 2005

(54) BLIND ASSEMBLY HAVING FABRIC BLIND SLATS

(75) Inventor: Ming Nien, Changhua Hsien (TW)

(73) Assignee: Nien Made Enterprise Co., Ltd., Taichung (TW)

( * ) Notice: Subject to any disclaimer, the term of this patent is extended or adjusted under 35 U.S.C. 154(b) by 0 days.

(21) Appl. No.: 10/378,829

(22) Filed: Mar. 5, 2003

(65) Prior Publication Data

US 2004/0103994 A1 Jun. 3, 2004

(30) Foreign Application Priority Data

Dec. 2, 2002 (TW) ..... 91219746 U

(51) Int. Cl.[7] ..... E06B 9/382

(52) U.S. Cl. ..... 160/176.1 R; 160/178.3 R; 160/236

(58) Field of Search ..... 160/178.3, 176.1 R, 160/177 R, 236

(56) References Cited

U.S. PATENT DOCUMENTS 1,789,655 A * 1/1931 Toshi-Ko ..... 160/173 R
1,851,782 A * 3/1932 Takeshi ..... 160/172 R
2,056,823 A * 10/1936 Brown ..... 160/133
2,374,591 A * 4/1945 Dunn ..... 160/177 R
2,608,249 A * 8/1952 Sealy ..... 160/177 R
3,256,928 A * 6/1966 Emil ..... 160/178.3
6,105,657 A * 8/2000 Zorbas ..... 160/236

* cited by examiner

*Primary Examiner*—Blair M. Johnson
(74) *Attorney, Agent, or Firm*—Bacon & Thomas, Pllc

(57) ABSTRACT

A fabric blind assembly. The assembly includes a headrail, a bottom rail suspended below the headrail, fabric blind slats arranged in parallel between the headrail and the bottom rail. Each fabric blind slat includes two opposite long sides and two rigid rod members respectively mounted in the long sides. Each rod member includes coupling portions. Braided ladders are connected between the headrail and the bottom rail at two sides of the fabric blind slats. Each braided ladder includes retaining members spaced apart from one another at a predetermined distance and respectively fastened to the coupling potions of the rod members to keep the fabric blind slats positioned between the headrail and the bottom rail and spaced apart from one another at the predetermined distance.

12 Claims, 6 Drawing Sheets

BLIND ASSEMBLY HAVING FABRIC BLIND SLATS

BACKGROUND OF THE INVENTION

1. Field of the Invention

The present invention relates generally to blinds and, more particularly, to a blind assembly having fabric blind slats.

2. Description of the Related Art

A conventional fabric blind assembly regularly includes a headrail fixedly fastened to the top side of a window, a bottom rail suspended below the headrail, a plurality of fabric blind slats extended in transverse direction and arranged in parallel between the headrail and the bottom rail, and two ladder tapes longitudinally connected between the headrail and the bottom rail to connect the fabric blind slats. U.S. Pat. No. 6,105,657 discloses a fabric blind slat and a fabric Venetian blind assembly. The fabric blind slat includes an elongated strip of fabric. The strip of fabric has at least one longitudinally extending pocket on a longitudinal edge into which a relatively rigid support member is insertable. This design of fabric blind slat has drawbacks. When tilting the fabric blind slat, the fabric body of the fabric blind slat is relatively moved, thereby causing the upper part of the fabric blind slat to compress the lower part of the fabric blind slat, resulting in a wrinkle. In other words, supporting or stretching means must be provided so that the fabric body of the fabric blind slat can be maintained smooth under any operation status.

SUMMARY OF THE INVENTION

The present invention has been accomplished under the circumstances in view. It is the main object of the present invention to provide a fabric blind assembly, which has support means to hold the fabric blind slats constantly in a smooth status during the operation of the fabric blind assembly. It is another object of the present invention to provide a fabric blind assembly, which is detachable.

To achieve the foregoing objects of the present invention, the fabric blind assembly is composed of a headrail, a bottom rail suspended below the headrail, a plurality of fabric blind slats arranged in parallel between the headrail and the bottom rail, each fabric blind slat having two opposite long sides and two rigid rod members respectively mounted in the long sides, each rod member having a plurality of coupling portions, and a plurality of braided ladders connected between the headrail and the bottom rail at two sides of the fabric blind slats, each braided ladder having a plurality of retaining members spaced apart from one another at a predetermined distance and respectively fastened to the coupling portions of the rod members to keep the fabric blind slats between the headrail and the bottom rail and spaced apart from one another at the predetermined distance.

DETAILED DESCRIPTION OF THE INVENTION

Figure 1:
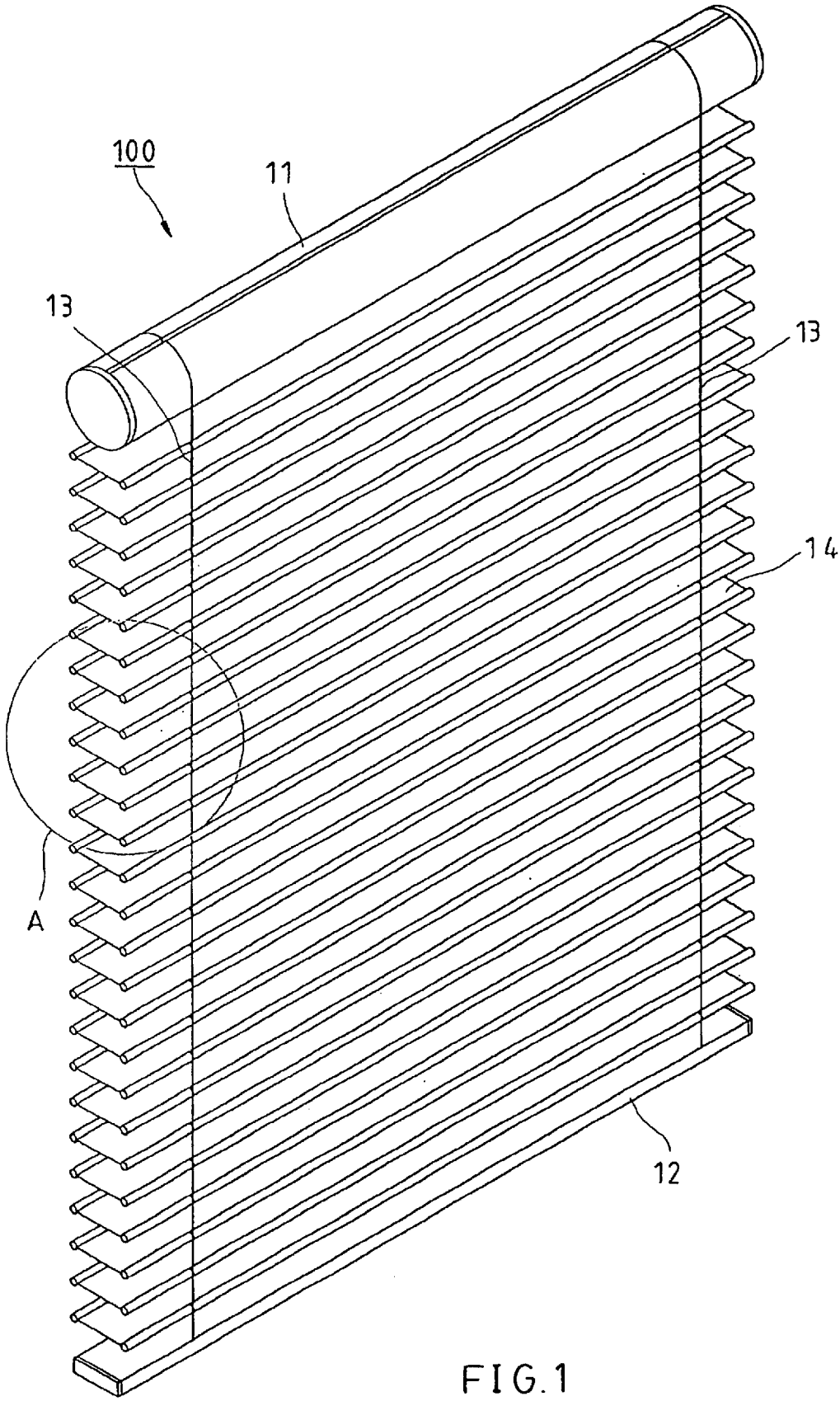
FIG. 1 is a perspective view of a fabric blind assembly according to a first preferred embodiment of the present invention.
Figure 2:
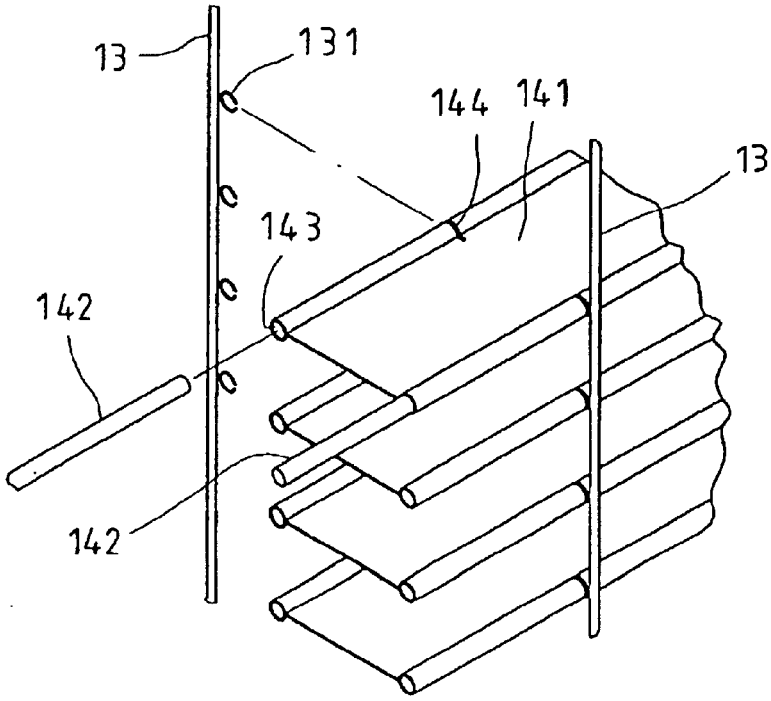
FIG. 2 is an exploded view of a part of the fabric blind assembly according to the first preferred embodiment of the present invention.
Figure 3:
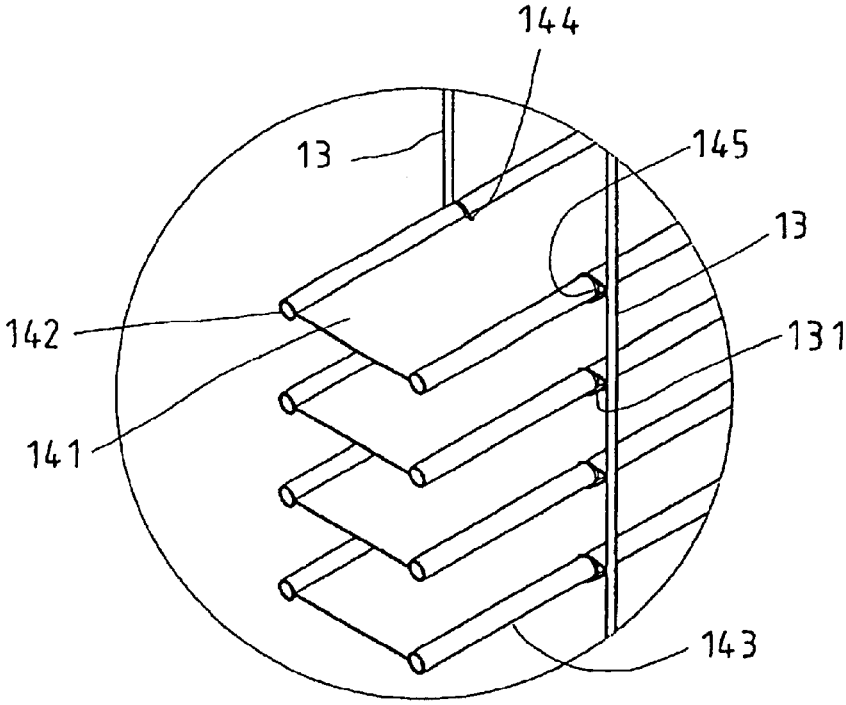
FIG. 3 is an enlarged view of part A in FIG. 1.
Figure 4:
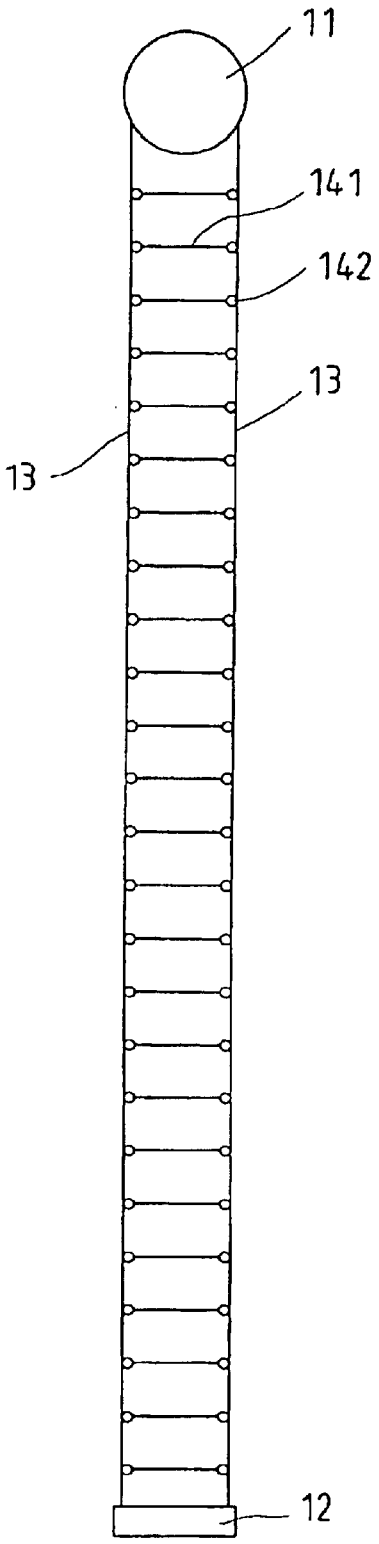
FIG. 4 is a side view of the fabric blind assembly according to the first preferred embodiment of the present invention.
Figure 5:
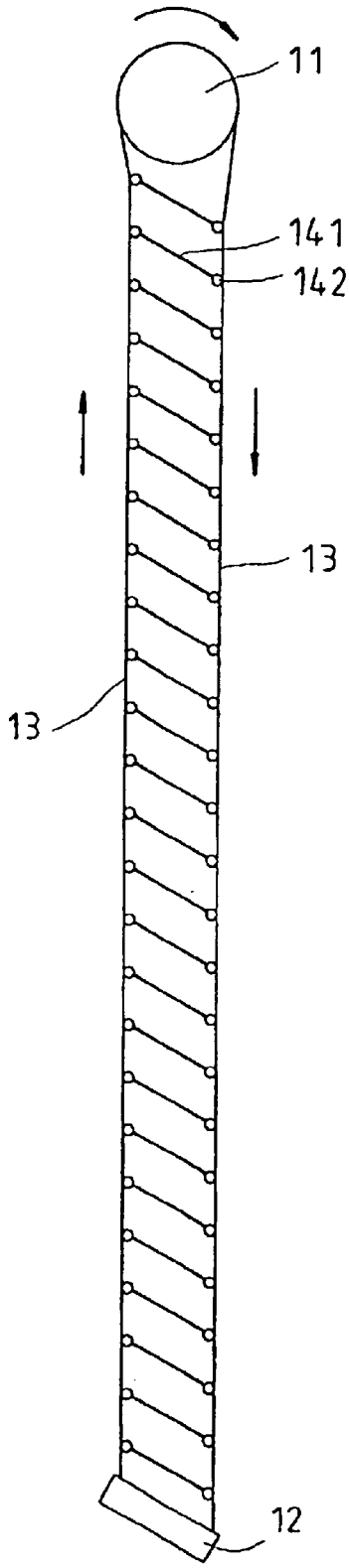
FIG. 5 is a side view of the first preferred embodiment of the present invention at work.

Referring to FIGS. 1–5, a fabric blind assembly 100 in accordance with the first preferred embodiment of the present invention is composed of a headrail 11 formed of a barrel, a bottom rail 12 extended in transverse direction and suspended below the headrail 11, a plurality of fabric blind slats 14 arranged in parallel between the headrail 11 and the bottom rail 12, and two pairs of braided ladders 13 vertically bilaterally connected between the headrail 11 and the bottom rail 12 to connect the fabric blind slats 14 and to hold the fabric blind slats 14 in parallel.

Each fabric blind slat 14 includes an elongated strip of fabric 141 and two rod members 142. The strip of fabric 141 is a piece of opaque or semitransparent fabric capable of protecting from light, having two pockets 143 longitudinally extended along two opposite long sides thereof The pockets 143 can be formed of a part of the strip of fabric 141 by stitching or bonding. Each pocket 143 has transversely extended crevices 144. The rod members 142 are rigid members, having an outer diameter smaller than the inner diameter of the pockets 143. The length of the rod members 142 is substantially equal to the longitudinal depth of the pockets 143. When inserted into the pockets 143, the rod members 142 can be slightly rotated in the pockets 143. Further, each rod member 142 has a plurality of coupling portion 145 corresponding to the crevices 144 (see FIG. 3).

The braided ladders 13 are vertically bilaterally connected between the headrail 11 and the bottom rail 12 at two sides of the fabric blind slats 14, each having a plurality of equally vertically spaced retaining members 131 corresponding to the fabric blind slats 14. The retaining members 131 according to this embodiment are C-shaped retainers formed of injection molding on the braided ladders 13, having a proper toughness and resilience. After insertion of the rod members 142 into the pockets 143, the retaining members 131 of the braided ladders 13 are respectively inserted into the crevices 144 and fastened to the coupling portions 145 of the rod members 142 (see FIG. 3).

According to the aforesaid fabric blind assembly 100, the rigid rod members 142 support the fabric blind slats 14 in longitudinal direction, prohibiting the strip of fabric 141 of each fabric blind slat 14 from curving downwards, and the braided ladders 13 support the fabric blind slats 14 in transverse direction, keeping the fabric blind slats 14 in a smooth status.

Further, because the rod members 142 are fastened to the retaining members 131 of the braided ladders 13 to keep the fabric blind slats 14 secured to the braided ladders 13, the fabric blind slats 14 can be removed from the braided ladders 13 for washing. Because the retaining members 131 are springy, they can easily be deformed with external forces and then fastened to or disconnected from the coupling portions 145 of the rod members 142 without causing damage.

The pitch of the retaining members 131 is substantially equal to the transverse width (the length of the short sides) of the fabric blind slats 14. When wishing to enhance the light shading effect of the fabric blind assembly 100, the user can rotate the headrail 11 through a predetermined angle to move the two opposite long sides of each fabric blind slat 14 toward the top and bottom sides in reversed directions relative to the respective retaining members 131 to change the fabric blind slats 14 from a horizontal position (see FIG. 4) to about a vertical position (see FIG. 5), thereby closing the gaps in between the fabric blind slats 14.

Because the rod members 142 can be rotated relative to the retaining members 131 of the braided ladders 13, rotating the headrail 11 to tilt the fabric blind slats 14 causes the retaining members 131 to be turned relative to the rod members 142, thereby preventing uneven tension between the braided ladders 13 and the fabric blind slats 14.

Figure 6:
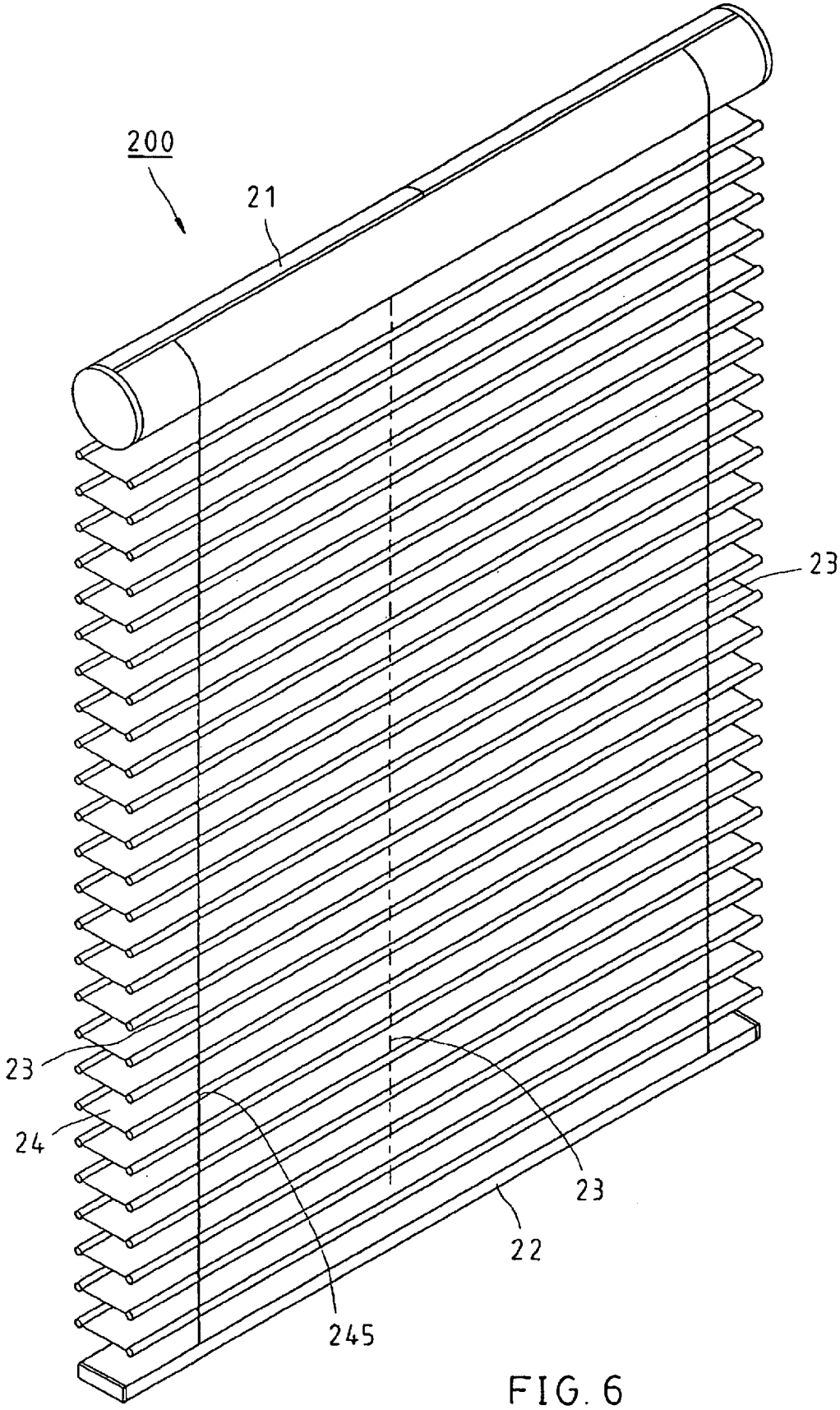
FIG. 6 is a perspective view of a fabric blind assembly according to a second preferred embodiment of the present invention.
Figure 7:
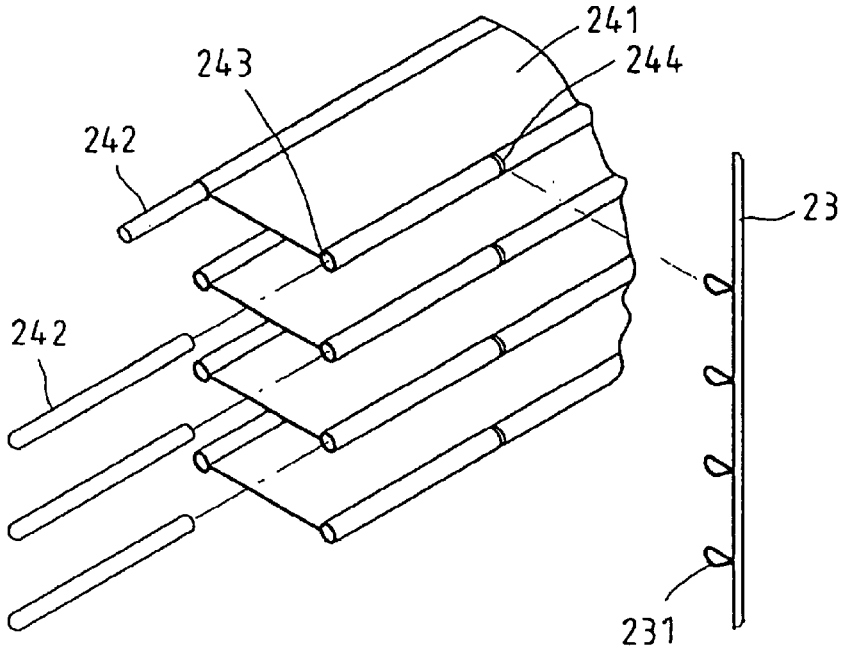
FIG. 7 is an exploded view in an enlarged scale of a part in FIG. 5.

FIGS. 6 and 7 show a fabric blind assembly 200 constructed according to a second preferred embodiment of the present invention. According to this embodiment, the fabric blind assembly 200 is composed of a headrail 21, a bottom rail 22, a plurality of braided ladders 23, and a plurality of fabric blind slats 24. According to this embodiment, there are three braided ladders 23. Two braided ladders 23 are vertical bilaterally connected between the headrail 21 and the bottom rail 22 at a long side of the fabric blind slats 24 and in proximity of the two opposite vertical lateral sides of the fabric blind assembly 200. The other braided ladder 23 is vertically connected between the headrail 21 and the bottom rail 22 and at the middle of the other long side of the fabric blind slats 24. Each of the braided ladders 23 has a plurality of equally vertically spaced retaining members 231, embodied as loops, for fastening to the fabric blind slats 24.

Each fabric blind slat 24 is composed of an elongated strip of fabric 241 and two rod members 242. The strip of fabric 241 has two pockets 243 longitudinally extended along two opposite long sides thereof One of the two pocket 243 of each fabric blind slat 24 is provided with two transversely extended crevices 244, and the other pocket 243 of each fabric blind slat 24 is provided with a transversely extended crevice 244. The rod members 242 are rigid and inserted into the pockets 243. Each of the rod members 142 has at least one coupling portion 245. Before insertion of the rod members 242 into the pockets 243, the retaining members 231 of the braided ladders 23 are respectively inserted into the crevices 244 of the pockets 243 of the fabric blind slats 24, and then the rod members 242 are respectively inserted into the pockets 243 and the retaining members 231, enabling the coupling portions 245 of the rod members 242 to be respectively secured to the retaining members 243.

Figure 9:
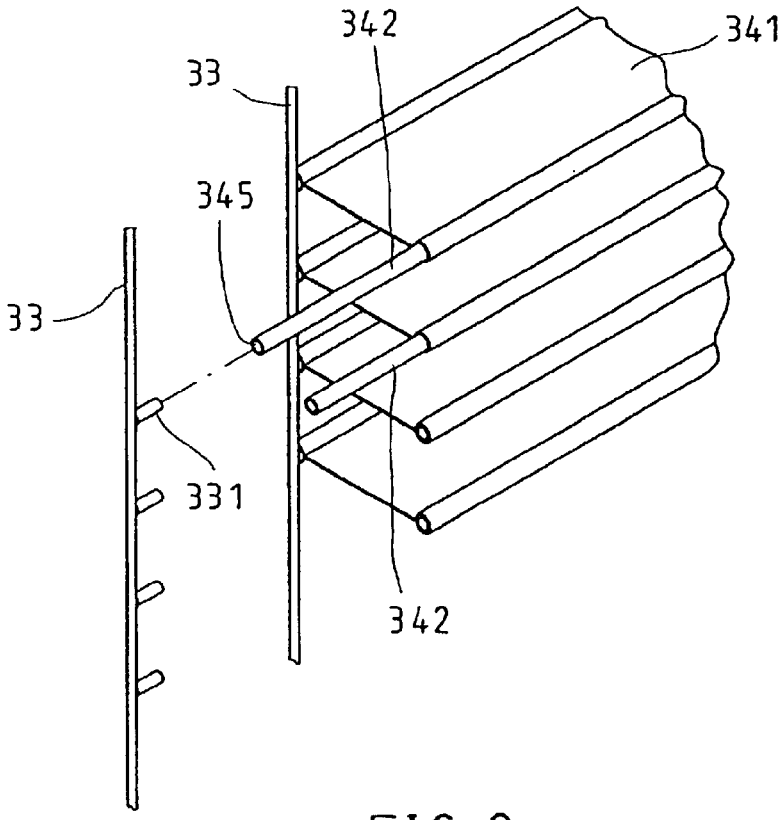
FIG. 9 is an exploded view in an enlarged scale of a part in FIG. 7.
Figure 8:
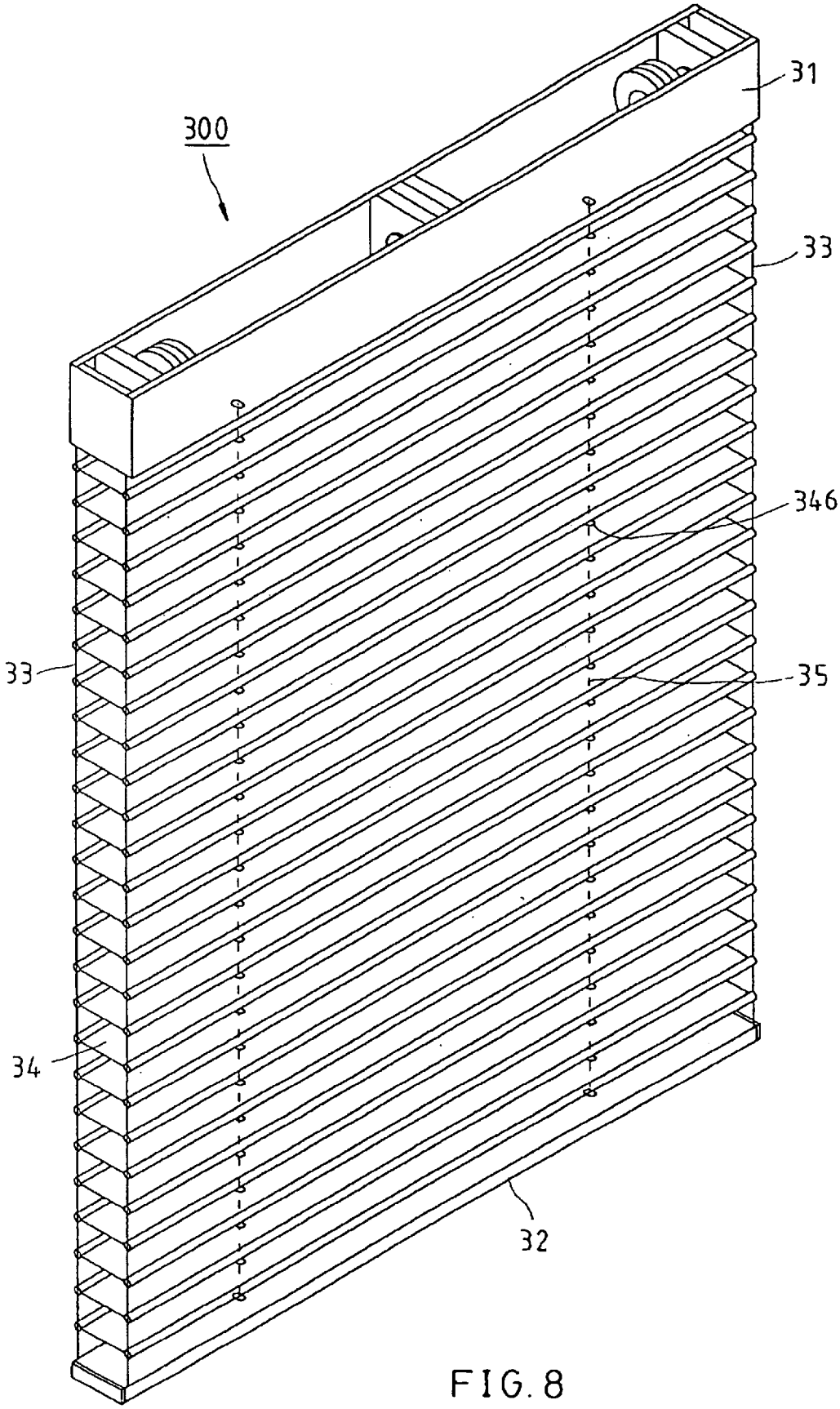
FIG. 8 is a perspective view of a fabric blind assembly according to the third preferred embodiment of the present invention.

FIGS. 8 and 9 show a fabric blind assembly 300 constructed according to a third preferred embodiment of the present invention. According to this embodiment, the fabric blind assembly 300 is composed of a headrail 31, a bottom rail 32, braided ladders 33, and fabric blind slats 34. The headrail 31 is a rectangular open frame fixedly fastened to the top side of a window in transverse direction, having a frequency control mechanism and an amplitude control mechanism (not shown) mounted therein and connected with the braided ladders 33 for controlling the tilting angle of the fabric blind slats 34 and the elevation of the bottom rail 32 respectively. The frequency control mechanism and the amplitude control mechanism are of prior arts and not within the scope of the claims of the present invention, no further detailed description is necessary in this regard. The strip of fabric 341 of each fabric blind slat 34 has two through holes 346 positioned at the fabric blind slat 34 and symmetrically spaced from the center of the fabric blind slat 34.

The headrail 31 includes a frequency control mechanism and an amplitude control mechanism mounted therein. The frequency control mechanism is connected to the braided ladders 33 to adjust the tilting angle of the fabric blind slats 34. The amplitude control mechanism is connected with a lift cord that is connected with the bottom rail 32 for driving the lift cord to move the bottom rail 32 and the fabric blind slats 34 to the desired elevation.

The fabric blind assembly 300 further includes a cylindrical lift cord 35. The lift cord 35 is inserted through the through holes 346 of the fabric blind slats 34 and has two distal ends respectively connected with the amplitude control mechanism and fixedly fastened to the bottom rail 32. Therefore, operating the amplitude control mechanism causes the bottom rail 32 and the fabric blind slats 34 to be lifted or lowered to the desired elevation.

The retaining members 331 of the braided ladders 33 are cylindrical pins. Each of the rod members 342 of the fabric blind slat 34 has two coupling portions 345 respectively disposed at two distal ends. The coupling portions 345 of the rod members 342 according to this embodiment are plug holes adapted to receive the cylindrical pins 331 of the braided ladders 33.

What is claimed is:

1. A fabric blind assembly comprising:

a headrail;

a bottom rail located below said headrail;

a plurality of fabric blind slats arranged in parallel between said headrail and said bottom rail, each of said fabric blind slats having two opposite long sides and two rigid rod members respectively mounted in said long sides, each of said rod members having at least one coupling portion;

a plurality of braided ladders connected between said head rail and said bottom rail at the two opposite long sides of each of said fabric blind slats, each of said braided ladders having a plurality of retaining members respectively spaced apart from one another at a predetermined distance and respectively fastened to the coupling portions of said rod members of said fabric blind slats to keep said fabric blind slats between said headrail and said bottom rail and spaced apart from one another at the predetermined distance;

said fabric blind slats each comprises an elongated strip of fabric, said strip of fabric having two pockets respectively extended along said two opposite long sides thereof and adapted to receive the rod members respectively, each of said pockets each having at least one transversely extended crevice corresponding to said coupling portion of the respective rod member; and the retaining members of said braided ladders are springy C-shaped retainers respectively inserted into the crevices of the pockets of said fabric blind slats and clamped to the coupling portions of said rod members of said fabric blind slats.

2. The fabric blind assembly as claimed in claim 1, wherein said headrail is a barrel rotatable to roll up said braided ladders and said fabric blind slats.

3. The fabric blind assembly as claimed in claim 1, wherein said headrail is a rectangular open frame having a frequency control mechanism and an amplitude control mechanism mounted therein, said frequency control mechanism being connected to said braided ladders for driving said braided ladders to adjust the tilting angle of said fabric blind slats, said amplitude control mechanism being connected with a lift cord that is connected with said bottom rail for driving said lift cord to move said bottom rail and said fabric blind slats vertically to the desired elevation.

4. The fabric blind assembly as claimed in claim 1, wherein the retaining members of said braided ladders are loops respectively formed integrally with said braided ladders and respectively inserted into the crevices of said pockets of said fabric blind slats and connected with the coupling portions of the rod members of said fabric blind slats.

5. The fabric blind assembly as claimed in claim 1, wherein the number of said braided ladders is arranged in two pairs bilaterally disposed at two sides of said fabric blind slats; wherein each said rod member has two of said coupling portions corresponding to said retaining members of said two pairs of braided ladders.

6. The fabric blind assembly as claimed in claim 1, wherein said braided ladders include a first braided ladder connected between said headrail and said bottom rail at the middle of a first side of said fabric blind slats, and two second braided ladders bilaterally connected between said headrail and said bottom rail at a side opposite to the first side and equally spaced from said first braided ladder; wherein said rod members of each said fabric blind slat include a first rod member and a second rod member, said first rod member having one of said coupling portions fastened to a retaining member of said first braided ladder, said second rod member having two of said coupling portions respectively fastened to a retaining member of each said second braided ladder.

7. A fabric blind assembly comprising:

a headrail;

a bottom rail located below said headrail;

a plurality of fabric blind slats arranged in parallel between said head rail and said bottom rail, each of said fabric blind slats having two opposite long sides and two rigid rod members respectively mounted in said long sides, each of said rod members having at least one coupling portion;

a plurality of braided ladders connected between said headrail and said bottom rail at the two opposite long sides of each of said fabric blind slats, each of said braided ladders having a plurality of retaining members respectively spaced apart from one another at a predetermined distance and respectively fastened to the coupling portions of said rod members of said fabric blind slats to keep said fabric blind slats between said headrail and said bottom rail and spaced apart from one another at the predetermined distance; and said retaining members are cylindrical;

wherein each said fabric blind slat comprises an elongated strip of fabric, said strip of fabric having two pockets respectively extended along said two opposite long sides thereof and adapted to receive said rod members of the respective one of said fabric blind said slats respectively;

wherein each said rod member comprises two of said coupling portions respectively formed in two distal ends thereof for said retaining members inserted thereinto.

8. The fabric blind assembly as claimed in claim 7, wherein said headrail is a barrel rotatable to roll up said braided ladders and said fabric blind slats.

9. The fabric blind assembly as claimed in claim 7, wherein said headrail is a rectangular open frame having a frequency control mechanism and an amplitude control mechanism mounted therein, said frequency control mechanism being connected to said braided ladders for driving said braided ladders to adjust the tilting angle of said fabric blind slats, said amplitude control mechanism being connected with a lift cord that is connected with said bottom rail for driving said lift cord to move said bottom rail and said fabric blind slats vertically to the desired elevation.

10. The fabric blind assembly as claimed in claim 7, wherein the retaining members of said braided ladders are loops respectively formed integrally with said braided ladders and respectively inserted into crevices of said pockets of said fabric blind slats and connected with the coupling portions of the rod members of said fabric blind slats.

11. The fabric blind assembly as claimed in claim 7, wherein the number of said braided ladders is arranged in two pairs bilaterally disposed at two sides of said fabric blind slats.

12. The fabric blind assembly as claimed in claim 7, wherein slid braided ladders include a first braided ladder connected between said headrail and said bottom rail at the middle of a first side of said fabric blind slats, and two second braided ladders bilaterally connected between said headrail and said bottom rail at a side opposite to the first side and equally spaced from said first braided ladder; wherein said rod members of each said fabric blind slat include a first rod member and a second rod member, said first rod member having one of said coupling portions fastened to a retaining member of said first braided ladder, said second rod member having two of said coupling potions respectively fastened to a retaining member of each said second braided ladder.

* * * * *